US009951506B2

(12) United States Patent
Lin et al.

(10) Patent No.: US 9,951,506 B2
(45) Date of Patent: Apr. 24, 2018

(54) WATER REPLENISHING DEVICE FOR A FLUSH RIM OF A TOILET AND TOILET INCLUDING THE SAME

(71) Applicant: KOMOO INTELLIGENT TECHNOLOGY CO., LTD., Xiamen (CN)

(72) Inventors: Xiaofa Lin, Xiamen (CN); Xiaoshan Lin, Xiamen (CN); Shan Lin, Xiamen (CN); Dahai Que, Xiamen (CN); Jinyang Zheng, Xiamen (CN)

(73) Assignee: KOMOO INTELLIGENT TECHNOLOGY CO., LTD., Xiamen (CN)

( * ) Notice: Subject to any disclaimer, the term of this patent is extended or adjusted under 35 U.S.C. 154(b) by 0 days.

(21) Appl. No.: 15/112,612

(22) PCT Filed: Feb. 3, 2016

(86) PCT No.: PCT/CN2016/073364

§ 371 (c)(1),
(2) Date: Jul. 19, 2016

(87) PCT Pub. No.: WO2016/165456

PCT Pub. Date: Oct. 20, 2016

(65) Prior Publication Data

US 2017/0058503 A1 Mar. 2, 2017

(30) Foreign Application Priority Data

Apr. 16, 2015 (CN) ..... 2015 2 0229261 U
Dec. 16, 2015 (CN) ..... 2015 2 1051585 U
(Continued)

(51) Int. Cl.
*E03D 1/30* (2006.01)
*E03D 5/02* (2006.01)
(Continued)

(52) U.S. Cl.
CPC ..... *E03D 11/13* (2013.01); *E03D 1/306* (2013.01); *E03D 1/32* (2013.01); *E03D 5/028* (2013.01);
(Continued)

(58) Field of Classification Search
CPC ..... E03D 11/13; E03D 1/22; E03D 2201/20
See application file for complete search history.

(56) References Cited

U.S. PATENT DOCUMENTS 2,492,436 A * 12/1949 Owens ..... E03D 1/12 137/145
5,685,026 A * 11/1997 Chuang ..... E03D 1/145 4/326
(Continued)

*Primary Examiner* — Janie Loeppke
(74) *Attorney, Agent, or Firm* — Rabin & Berdo, P.C.

(57) ABSTRACT

A toilet is provided with a water replenishing device for a flush rim with a silencing function. The water replenishing device has independent drainage from the drainage of the cistern. The water replenishing device includes a water storage box with a water inlet on a top side and a drainage outlet on a bottom side. The drainage outlet is connected to the waterway for the flush rim. A lid is installed in the water storage box to open or close the drainage outlet. The water storage box is provided with a water storage area. A back-flow channel has one end connected to the water inlet and the other end extending into the water storage area below or equal to the highest level of the water storage area. Such toilets make less noise by eliminating water inlet noise.

14 Claims, 12 Drawing Sheets

(30) Foreign Application Priority Data

Dec. 16, 2015 (CN) ..... 2015 2 1051804 U
Feb. 1, 2016 (CN) ..... 2016 2 0100033 U

(51) Int. Cl.

| | |
|---|---|
| ***E03D 9/14*** | (2006.01) |
| ***E03D 11/13*** | (2006.01) |
| ***E03D 11/00*** | (2006.01) |
| ***E03D 5/09*** | (2006.01) |
| ***E03D 5/094*** | (2006.01) |
| ***E03D 11/02*** | (2006.01) |
| ***E03D 1/32*** | (2006.01) |

(52) U.S. Cl.

CPC ..... *E03D 5/09* (2013.01); *E03D 5/094* (2013.01); *E03D 9/14* (2013.01); *E03D 11/00* (2013.01); *E03D 11/02* (2013.01); *E03D 2201/20* (2013.01)

(56) References Cited

U.S. PATENT DOCUMENTS

2006/0015993 A1* 1/2006 Hennessy ..... E03D 1/142 4/300
2010/0058524 A1* 3/2010 Wajda ..... E03D 1/145 4/326

* cited by examiner

WATER REPLENISHING DEVICE FOR A FLUSH RIM OF A TOILET AND TOILET INCLUDING THE SAME

FIELD OF THE INVENTION

The present invention is related to a toilet pan structure, and more particularly related to a toilet pan structure with less noise.

BACKGROUND

For a conventional toilet pan using large water replenishing, such as a big unitary toilet pan, the cistern is set in a low position. When drainage is started and before a toilet pan flush is finished and when the water level is going down so that the inlet valve starts supplying water, water from the inlet valve is flowing through tubes to replenish water to perform rim flushing, i.e., a flush rim, of a toilet pan for flushing and cleaning the toilet. Under the influence of the pressure of water input, the replenishing water speed deviation of the inlet value would be large. Therefore, it is difficult to replenish the toilet pan accurately. When water pressure is low and the volume of replenishing water is small, the ceramics surface of the toilet pan may not be washed cleanly, affecting use quality of the toilet pan. On the other hand, when water pressure is high, it causes water waste.

For traditional large water replenishing models, when drainage is started and before toilet flush is finished, and when the water level is going down to the inlet valve for start supplying water, water is flowing from the inlet valve through tubes to replenish water for performing flush rim of the toilet. By this method, after the toilet cistern is full of water inlet and the inlet valve is closed, the water supply will be stopped flush rim. It will take long time to supply the water for flush rim. When the pressure is over, it will make water waste.

Therefore, a large water replenishing device is invented. The large water replenishing device includes a water storage box with a water inlet and an outlet hole, as well as an overflow tube. The overflow tube is connected to the cistern. During water entering, water from the inlet valve flows into the water storage box through the water inlet. When water level is up the height of the overflow tube, water flows into the cistern through the overflow tube. Until the water level is going up to the required working water level, the inlet valve would stop water entering. When drainage starts, water is drained from the cistern and the water storage box is used to replenish water for performing flush rim. In order to install an anti-siphon mechanism, the water inlet of the water storage box is always set on the top of the water storage box to make difference heights between the water inlet of the water storage box and the bottom end of the water storage box. Consequently, when water is entering, water will make direct impact on the water storage box and makes large inlet noise.

SUMMARY OF THE INVENTION

The present invention is provided with a water replenishing device for flush rim with silence function, and a toilet pan with a water replenishing device for flush rim to overcome the disadvantages of existing structure in prior art.

One technical solution to the above technical problems for the present invention is that:

A water replenishing device for flush rim, the water replenishing device with drainage independent from drainage of the cistern set on a toilet pan, includes a water storage box with a water inlet on top side and a drainage outlet on bottom side. The drainage outlet communicates with the waterway for flush rim. A lid is installed in the water storage box to open or close the drainage outlet. The water storage box is provided with a water storage area and a back flow channel One end of the back flow channel is connected to the water inlet and the other end extends into the water storage area below or equal to the highest level of the water storage area.

In another preferred embodiment, the water storage box has an overflow tube, the bottom end of the overflow tube extends into the cistern while the bottom end is located below or equal to the water level of the cistern after the drainage of the cistern.

Another preferred embodiment further includes a muffler in the overflow tube. The muffler includes a center shaft and a spiral blade disposed spirally and downwardly along the center shaft. The outer diameter of the spiral blade is adapted to the inner diameter of the overflow tube. The bottom end of the spiral blade is positioned below or equal to the water level of the cistern after the drainage of the cistern.

In another preferred embodiment, a stop pillar with outer diameter less than the inner diameter of the overflow tube is downwardly extended from top surface of the inner side of the water storage box. The stop pillar extends into the overflow tube.

In another preferred embodiment, top of the water storage box is disposed with a water-through cavity communicating with the water inlet. The upper cavity wall of the water-through cavity is provided with an atmospheric communication hole. The bottom of the water-through cavity is disposed with a water entry hole connected to a water source. The atmospheric communication hole is corresponds to the water entry hole with an upper and lower manner. The atmospheric communication hole is provided with an anti-siphon cushion. The upper cavity wall of the water-through cavity is downwardly provided with an enclosed-type isolation wall. The anti-siphon cushion is placed inside the isolation wall.

In another preferred embodiment, the anti-siphon cushion includes a guiding pillar, a first sealing plate and a second sealing plate. The first sealing plate is coupled outside of the guiding pillar. The guiding pillar is in movably inserted connection with the atmospheric communication hole. The first sealing plate is placed below the atmospheric communication hole. The second sealing plate is integrally molded at the bottom end of the guiding pillar and with same axis as the guiding pillar. The first sealing plate is set onto the second sealing plate.

In another preferred embodiment, the lid is installed in the water storage box via a rotary support. The rotary support is connected to a drive mechanism via an activating drawstring. The lid is controlled by the drive mechanism to open. And the water replenishing device further comprises a float object in the cistern for controlling the lid to close. The float object is connected to the rotary support with a closing drawstring.

Another preferred embodiment also includes a weight balancing block on the rotary support. A first connection piece and a second connection piece are respectively and rotably installed on the rotary support or the weight balancing block. The activating drawstring is connected with the first connection piece. The closing drawstring is connected with the second connection piece.

In another preferred embodiment, the float object is provided with a water storage cavity. The water storage box is vertically disposed with a guiding tube. The bottom end of the guiding tube extends to the bottom of the water storage box. The float object is movably coupled outside of the guiding tube with top-down movement along the guiding tube. One end of the closing drawstring is connected to the rotary support and the other end is through the guiding tube and then connected to the float object. The water storage box is disposed with a water replenishing tube to replenish the water storage cavity of the float object. Water flows out of the replenishing tube then flows into the water storage cavity of the float object along the outer sidewall of the water storage box.

A toilet pan with a water replenishing device for flush rim includes the water replenishing device for flush rim as mentioned above. The water storage box is set on the upper part of the cistern. Water is supplied from the inlet valve inside the cistern. The drainage outlet of the water storage box is communicated with the flush rim waterway. The lid is linked with the drainage valve of the toilet pan to open.

In another preferred embodiment, the lid is installed in the water storage box via a rotary support. The rotary support is connected to a drive mechanism by an activating drawstring. The lid and the drainage valve of the toilet pan are controlled by the drive mechanism to open. The drainage valve of the toilet pan is in the form of lid drainage valve. A float object is also included in the cistern for controlling the lid to close. The float object is connected to the rotary support by a closing drawstring.

In another preferred embodiment, the float object is provided with a water storage cavity. The water storage cavity is vertically disposed with a guiding tube. The bottom end of the guiding tube extends into the cistern. The float object is movably coupled outside of the guiding tube with top-down movement along the guiding tube. One end of the closing drawstring is connected to the rotary support and the other end is through the guiding tube then connected to the float object. The water storage box is disposed with a water replenishing tube to replenish the water storage cavity of the float object. Water is supplied from the inlet valve set inside the cistern into water replenishing tube. Water flows out of the replenishing tube then flows into the water storage cavity of the float object along the outer sidewall of the water storage box.

In another preferred embodiment, the drive mechanism includes a fixed body, a first drive swing arm, a second drive swing arm, a button with a teeth strip, a first gear wheel, and a second gear wheel. The button is movably connected to the fixed body with a reset elastic part between each other. The first gear wheel is in rotation connection with the fixed body and is meshed with the teeth strip of the button. The first drive swing arm, the second drive swing arm and the second gear wheel are respectively installed on the fixed body. The first drive swing arm and the second gear wheel are in coaxial movement with the first gear wheel. The second gear wheel is provided with a third gear wheel moving in the same axial as the second gear wheel. The third gear wheel is meshed with the second gear wheel. The first drive swing arm is connected to the drainage valve of the toilet pan through a draining drawstring. The second drive swing arm is connected to the rotary support through the activating drawstring.

The technical solution of the present invention has at least advantages as follows.

The invention by setting a water storage area in the water storage box, as well as a back flow channel set, one end of the back flow channel being connected to the water inlet while the other end extending into the water storage area as well as below or equal to the highest level of the water storage area, so that during water entering, water will be guided into the water storage area through the back flow channel firstly then goes into other area of the water storage box through the water storage area. Due to water remained in the water storage area and the setting of the back flow channel, there would be difference existing in height during water inlet, and due to little impact of water, the noise generated by water inlet impact on the water storage box would be eliminated for reducing the water inlet noise.

The invention by further making the overflow tube of the water storage box extend into the cistern, and making the bottom end of the overflow tube below the water level of cistern after drainage, when water flows into the cistern through the overflow tube, water would not make direct impact on the water surface of the cistern then to further reduce the water inlet noise.

The invention by further setting a muffler in the overflow tube, the muffler is preferred comprising a center shaft and a spiral blade which is going down spirally along the center shaft, the invention makes the water flowing route be prolonged by the spiral blade, consequently, to slow the flow speed and scatter the water flow, the impact of water will be reduced and the water inlet noise will be eliminated.

The invention includes setting an enclosed-type isolation wall on the upper cavity wall of the water-through cavity, and the anti-siphon cushion is placed inside the isolation wall. When water overflows the water-through cavity, the anti-siphon cushion will be positioned in the independent water area enclosed by the isolation wall so that the anti-siphon cushion is not influenced by water flow to seal the atmospheric communication hole effectively for preventing atmospheric communication hole from water leakage.

Because the guiding pillar and the first sealing plate of the anti-siphon cushion being both independent parts, the guiding pillar could be made of materials not easy to deform as well as with small friction coefficient, in order to make the anti-siphon cushion not to go bias or blocking during movement, means that, better the guiding effect of the guiding pillar, the sealing effect of the anti-siphon cushion will be better.

Both of the first connection piece and the second connection part could rotate in 360 degree, so that the closing drawstring and activating drawstring will not twining during working process to ensure normal function of the lid.

The float object adds its own weight by setting of a water storage cavity to store water instead of setting of a heavy bob, it will make the cost of fabrication be reduced.

The present invention will be further described with following drawings and the embodiments to make the present invention more clear and well-known, the embodiments of the pressing switching water outlet device of the present invention is used to describe the present invention but not to limit the scope of the present invention.

DETAILED DESCRIPTION OF THE EMBODIMENTS

Figure 1:
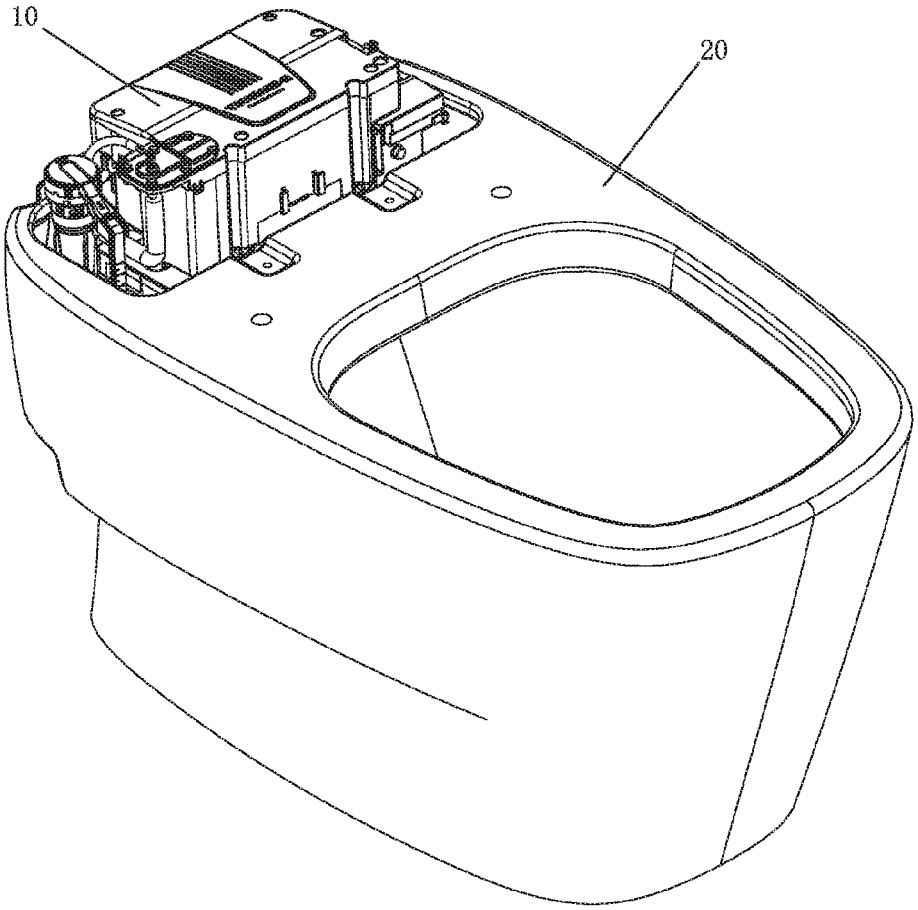
FIG. 1 illustrates a whole schematic diagram of the water replenishing device of the invention.

Please referring to FIGS. 1~11, the water replenishing device for flush rim of the invention, includes a water storage box 10 with a water inlet 11 on top side and a drainage outlet on bottom side. The drainage outlet is connected to the waterway for flush rim of the toilet pan 20. A lid 40 is installed in the water storage box 10 to open or close the drainage outlet via a rotary support 41. The lid 40 is connected to a drive mechanism 50 by an activating drawstring 42. The lid 40 is controlled by the drive mechanism 50 to open. A float object 60 is also included in the cistern 30 for controlling the lid 40 to close. The float object 60 is connected to the rotary support 41 by a closing drawstring 43. The water storage box 10 is provided with a water storage area 12 and a back flow channel 13. One end of the back flow channel 13 is connected to the water inlet 11 and the other end extends into the water storage area 12 below to the highest level of the water storage area 12 (or equal to the highest level of the water storage area 12).

Figure 3:
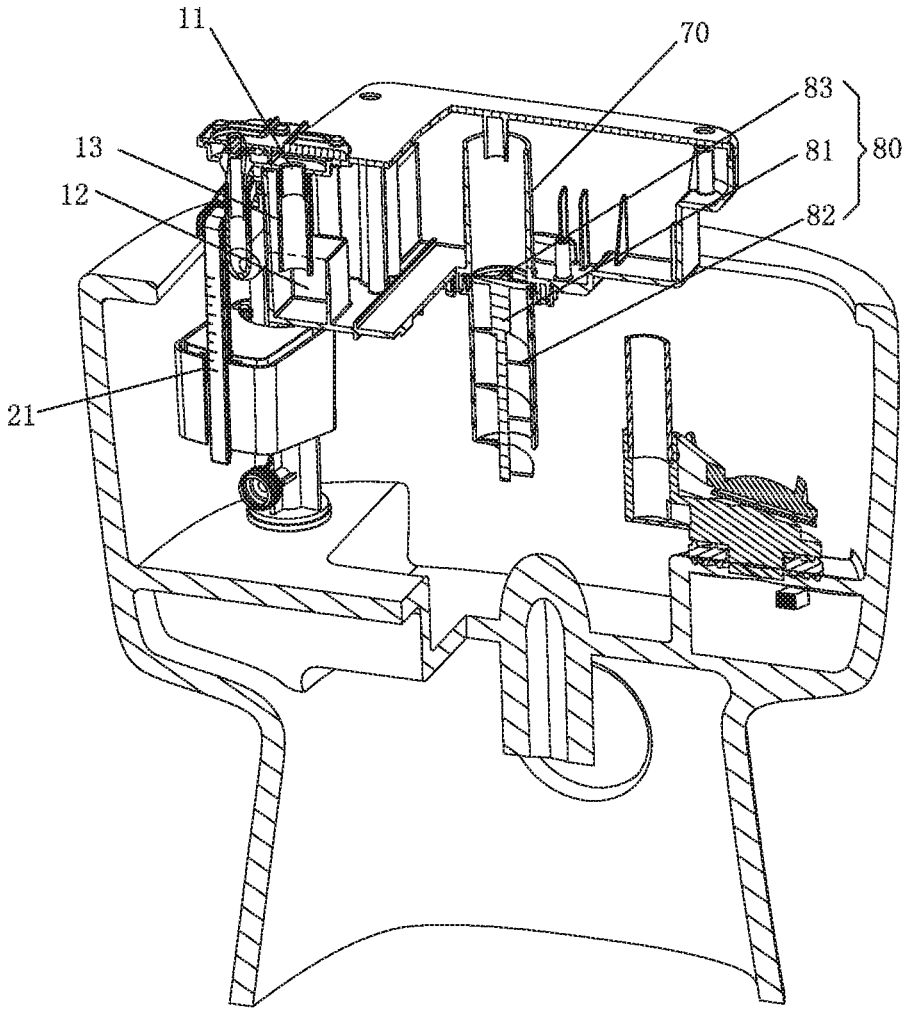
FIG. 3 illustrates a second sectional diagram of the invention.

In this embodiment, as FIG. 3 shown, the water storage box 10 is provided with an overflow tube 70 to replenish the cistern, bottom end of the overflow tube 70 extends into the cistern 30, as well as below the water level of the cistern 30 after the drainage of the cistern (or equal to the cistern 30 after the drainage of the cistern).

In this embodiment, a muffler 80 set is also included in the overflow tube 70. Specifically the muffler 80 includes a center shaft 81 and a spiral blade 82 which is going down spirally along the center shaft 81. The outer diameter of the spiral blade 82 is adapted to the inner diameter of the overflow tube 70. The bottom end of the spiral blade 82 is positioned below the water level of the cistern 30 after the drainage of the cistern (or equal to the cistern 30 after the drainage of the cistern).

The top of the center shaft 81 is formed a installing part 83 with a water entry aperture. The muffler 80 is installed in the overflow tube 70 through the installing part 83. The installing part 83 of the center shaft 81 is specifically composite of an annular part and two fixing stiffeners crisscross set in the annular part. The space enclosed by each two adjacent fixing stiffeners and the annular part is formed to be the water entry aperture. Top end of the center shaft 81 is integrally connected to the crisscross portion of several fixing stiffeners. The annular part is set in the overflow tube 70. The overflow tube 70 includes an upper tube and a lower tube communicating with each other in up and down way. The circumferential part is arranged in the connecting position between the upper tube and a lower tube. The bottom end of the upper tube of the overflow tube 70 is connected to the bottom surface of the water storage box 10 to form a unity part. The lower tube of the overflow tube 70 extends into the cistern 30 and the top end of the lower tube is fixed with the top end of the upper tube.

Figure 4:
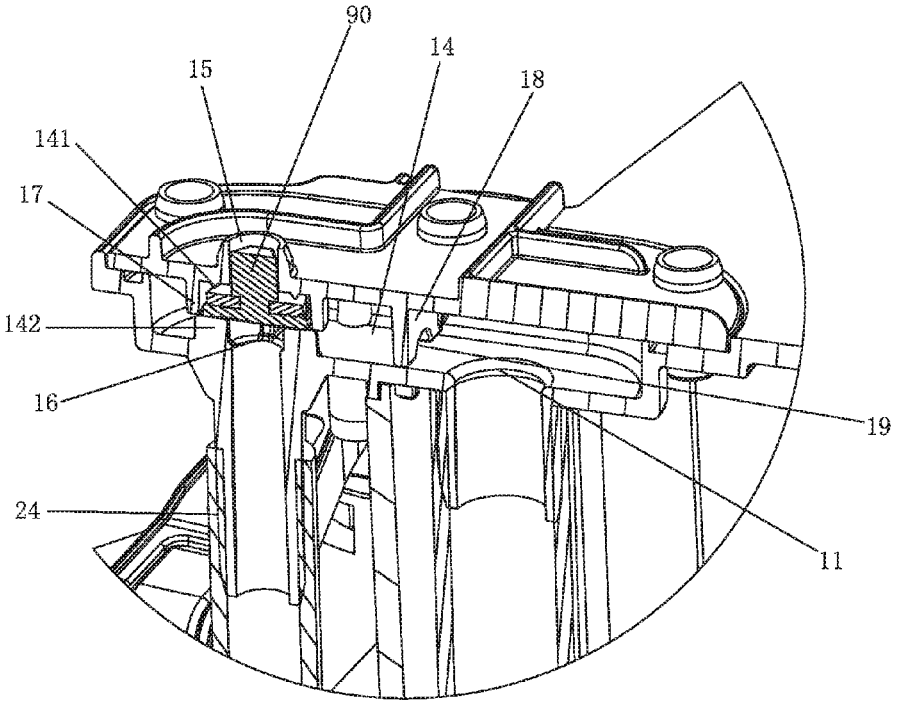
FIG. 4 illustrates a partial sectional diagram of the anti-siphon cushion in close status of the invention.
Figure 5:
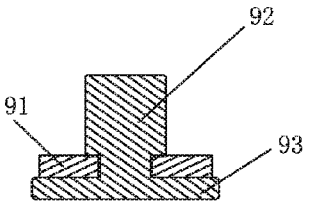
FIG. 5 illustrates a schematic diagram of the anti-siphon cushion of the invention.
Figure 6:
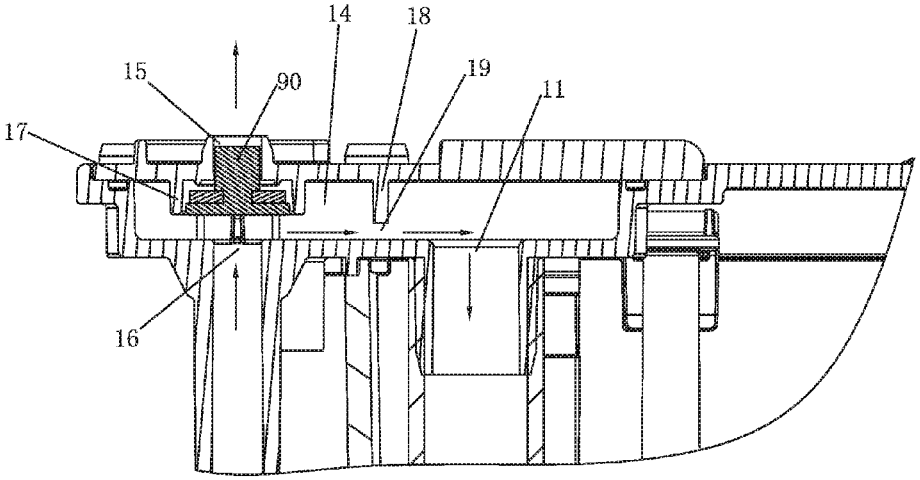
FIG. 6 illustrates a partial sectional diagram of the anti-siphon cushion in open status of the invention.

In this embodiment, as FIG. 4-6 shown, top of the water storage box 10 is disposed with a water-through cavity 14 communicating with the water inlet 11, the upper cavity wall of the water-through cavity 14 is provided with an atmospheric communication hole 15. The bottom of the water-through cavity 14 is disposed with a water entry hole 16 connected to a water source. The water entry hole 16 is specifically connected to the inlet valve of the cistern through a inlet tube 24. The atmospheric communication hole 15 is corresponds to the water entry hole 16 with an upper and lower manner. The atmospheric communication hole 15 is provided with an anti-siphon cushion 90. The upper cavity wall of the water-through cavity 14 is downwardly provided with an enclosed-type isolation wall 17. The anti-siphon cushion 90 is placed inside the isolation wall 17. The isolation wall 17 is in circumferential shape and set in the same axial as the atmospheric communication hole 15.

Additionally, the upper cavity wall of the water-through cavity 14 is downwardly provided with an isolation board 18 which bottom end is cooperated with the bottom of the water-through cavity 14 to form a water-through channel 19. The water inlet 11 and water entry hole 16 are both set in the bottom of the water-through cavity 14 and respectively arranged at both side of the water-through channel 19.

In this embodiment, as FIG. 5 shown, the anti-siphon cushion 90 includes a guiding pillar 92, a first sealing plate 91 and a second sealing plate 93. The first sealing plate 91 is coupled out of the guiding pillar 92. The guiding pillar 92 is in movable inserting connection with the atmospheric communication hole 15. The first sealing plate 91 is placed below the atmospheric communication hole 15. The second sealing plate 93 is integrally molded at the bottom end of the guiding pillar 92 and with same axis as the guiding pillar 92. The first sealing plate 91 is set onto the second sealing plate 93.

In this embodiment, the upper cavity wall of the water-through cavity 14 is downwardly provided with an annular upper flange 141 on the position corresponding with circumference of atmospheric communication hole 15 for attaching sealing to the anti-siphon cushion 90 during its upward movement. The annular upper flange 141 is placed at the inner side of the isolation wall 17 and with same axis as the atmospheric communication hole 15. The bottom of the water-through cavity 14 is provided with an annular lower flange 142 on the position corresponding with circumference of the water entry hole 16 for attaching sealing to the anti-siphon cushion 90 during its downward movement. Space between the bottom end of the isolation wall 17 and the top end of the annular lower flange 142 is formed a water-through gap. Specifically, the annular lower flange 142 is with same axis as the water entry hole 16.

As FIG. 6 shown, when water enters, the water flow direction and the moving direction of anti-siphon cushion 90 is as arrow shown in FIG. 6. Water flows into the water-through cavity 14 through the water entry hole 16, under the impact of the water flow and water pressure. The anti-siphon cushion 90 makes upward movement, then the first sealing plate 91 of the anti-siphon cushion 90 is in fast attaching sealing to the annular upper flange 141 to seal the atmospheric communication hole 15 for preventing atmospheric communication hole 15 from water leakage. Water flows to the water inlet 11 through water-through channel 19. When water stops entering, an isolation board 18 is downwardly set on the upper cavity wall of the water-through cavity 14, and the bottom end of isolation board 18 is cooperated with the bottom of the water-through cavity 14 to form a water-through channel 19. Therefore, before all drainage, the residual water in the water-through cavity 14 will flow in the direction of the water inlet 11 and the water entry hole 16 and with most of it flowing into the water storage box 10 through the water inlet 11. When water stops entering, the anti-siphon cushion 90 falls down due to its own weight and the second sealing plate 93 of the anti-siphon cushion 90 is in attaching sealing to the annular lower flange 142, in which condition the water-through cavity 14 communicates with the outer atmosphere through the atmospheric communication hole 15 so the vacuum condition is not existing then siphon phenomenon would not happen.

Figure 7:
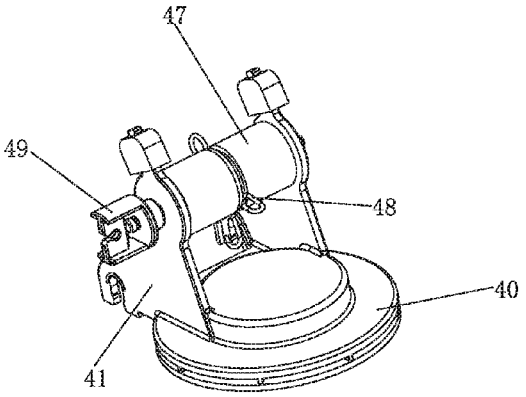
FIG. 7 illustrates a schematic diagram of the lid and the rotary support of the invention.

In this embodiment, as FIG. 7 shown, also includes a weight balancing block 47 set on the rotary support 41. A first connection piece 48 and a second connection piece 49 are also included. The first connection piece 48 is movably coupled outside of weight balancing block 47. The second connection piece 49 is installed on the rotary support 41 in rotation way. The activating drawstring 42 is connected with the first connection piece 48. The closing drawstring 43 is connected with the second connection piece 49.

Figure 2:
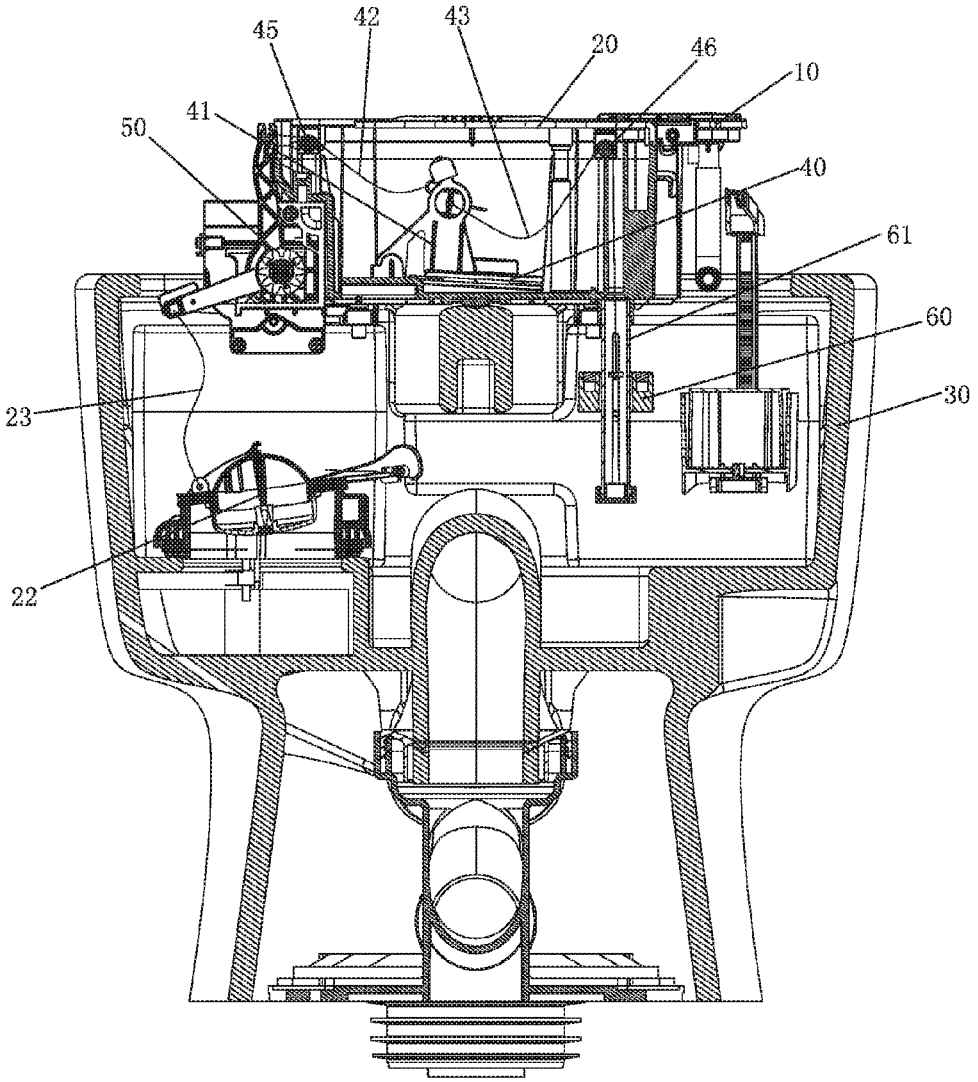
FIG. 2 illustrates a first sectional diagram of the invention.
Figure 8:
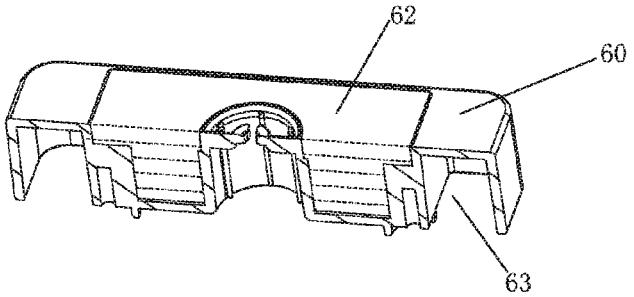
FIG. 8 illustrates a sectional diagram of the float object of the invention.

In this embodiment, as FIG. 8 shown, the float object 60 is provided with a water storage cavity 62. Top end of the water storage cavity 62 is open for water entering. Moreover, peripheral area of the float object 60 is disposed with an empty cavity 63 of bottom end open corresponding to the water storage cavity 62. The empty cavity 63 is used to provide the buoyancy of the float object. As FIG. 2 shows, the water storage box 10 is vertically disposed with a guiding tube 61. The bottom end of the guiding tube 61 extends to the bottom of the water storage box 10. The float object 60 is movably coupled outside of the guiding tube 61 with top-down movement along the guiding tube 61. One end of the closing drawstring 43 is connected to the rotary support 41 and the other end is through the guiding tube 61 and then connected to the float object 60. The water storage box 10 is disposed with a water replenishing tube 26 to replenish the water storage cavity 62 of the float object 60. Water flows out of the replenishing tube 26 then flows into the water storage cavity 62 of the float object 60 along the outer sidewall of the water storage box 10 to accomplish water replenishing in silence.

Figure 9:
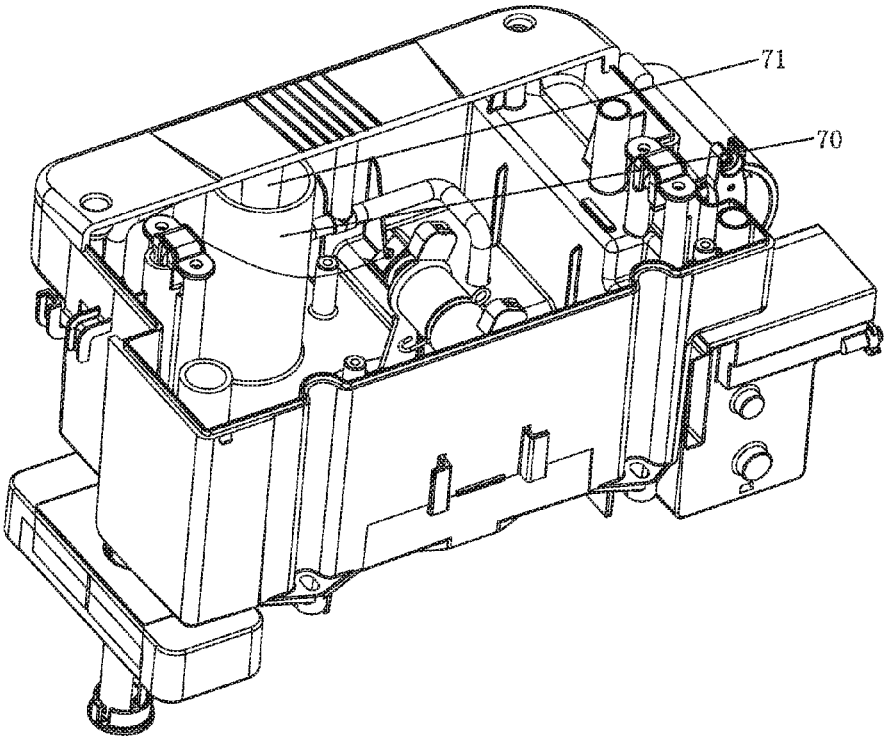
FIG. 9 illustrates the position schematic diagram of the stop pillar of the invention.

In this embodiment, as FIG. 9 shown, a stop pillar 71 with outer diameter smaller than the inner diameter of the overflow tube 70 is downwardly extended from top surface of the inner side of the water storage box 10. The stop pillar 71 extends into the overflow tube 70. The stop pillar 71 is used to prevent the activating drawstring 42 from twining on the overflow tube 70. The top of the inner side of the water storage box 10 is disposed with two rotators 45, 46, as shown in FIG. 2 shown. One end of the activating drawstring 42 is connected with the first connection piece 48 while the other end bypasses one rotator 45 then connects to the drive mechanism 50. One end of the closing drawstring 43 is connected with the second connection piece 49 and the other end bypasses another rotator 46 then connects to the float object 60.

Figure 10:
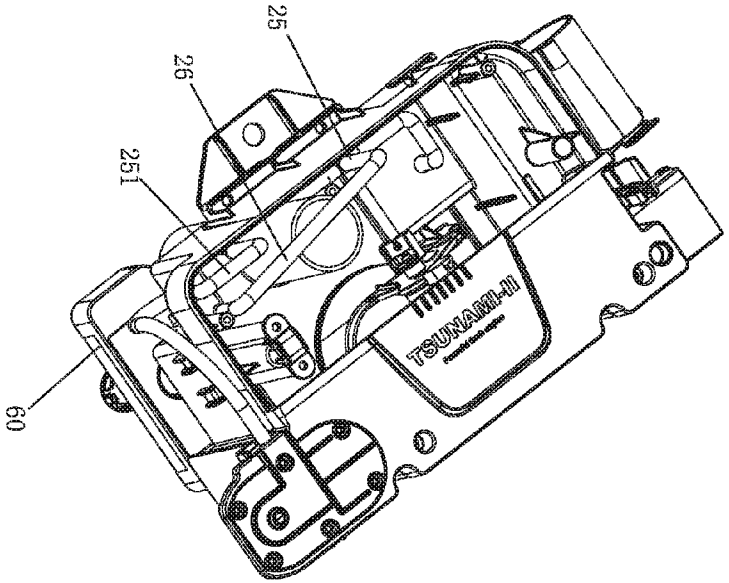
FIG. 10 illustrates the arrangement schematic diagram of the water replenishing tube on the water replenishing device of the invention.
Figure 11:
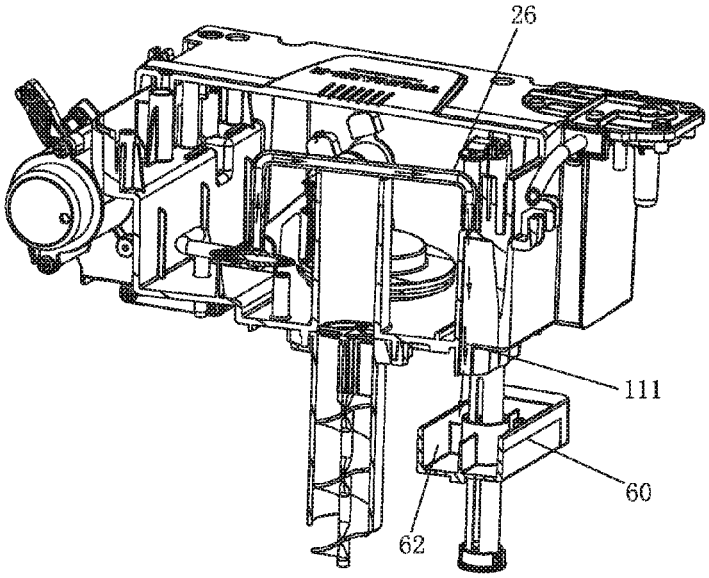
FIG. 11 illustrates the water replenishing schematic diagram of the float object water storage cavity of the invention.

In this embodiment, as shown in FIG. 10, a three-way pipe 25 is provided. The first end of the three-way pipe 25 is connected to the inlet valve 21 of the cistern 30 through the replenishing tube 251. The second end of the three-way pipe 25 is connected to the overflow aperture of the drainage valve of the toilet pan to replenish water to toilet water sealing. The third end is connected to the replenishing tube 26. Water flows out of the replenishing tube 26 then flows into the water storage cavity 62 of the float object 60 along the outer sidewall of the water storage box 10, as shown in FIG. 11. The outer sidewall of the water storage box 10 is disposed with a guiding groove 11 corresponding to the position of the water storage cavity 62, to further improve the effect of silence. As another accomplishing way, the first end of the three-way pipe 25 could be connected directly to the water-through cavity 14 of the water storage box 10.

A toilet pan with a water replenishing device for flush rim of the invention, as shown in FIGS. 1-13, includes a water replenishing device for flush rim mentioned as above. The water storage box 10 is set on the upper part of the cistern 30. Water is supplied from the inlet valve 21 set inside the cistern 30. The drainage outlet of the water storage box 10 is communicated with the flush rim waterway 27, as shown in FIG. 13. The lid 40 is linked with the drainage valve 22 of the toilet pan to open through the drive mechanism 50. The float object 60 is set in the cistern 30.

Figure 12:
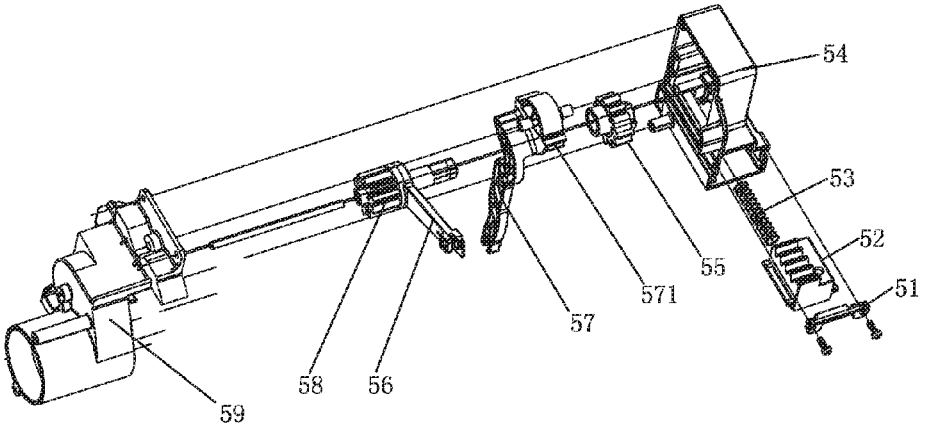
FIG. 12 illustrates an exploded view of the drive mechanism of the invention.
Figure 13:
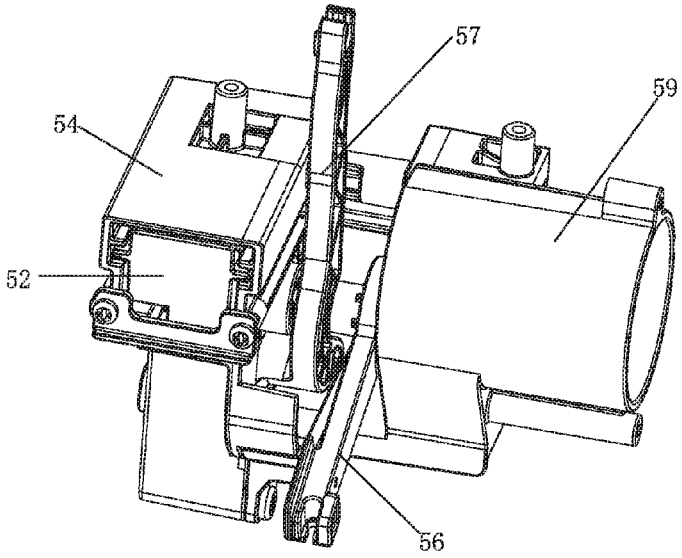
FIG. 13 illustrates a whole schematic diagram of the drive mechanism of the invention.

In this embodiment, as shown in FIGS. 12 and 13, the drive mechanism 50 includes a fixed body, a first drive swing arm 56, a second drive swing arm 57, a button 52 with a teeth strip, a first gear wheel 55 and a second gear wheel 58. The fixed body is formed by the connection between the first bracket 54 and the second bracket 59 and is installed on the cistern 30. The button 52 is movably connected to the first bracket 54 with a reset elastic part set between each other. The first gear wheel 55 is in rotation connection with the first bracket 54 and is meshed with the teeth strip of the button 52. The first drive swing arm 56, the second drive swing arm 57 and the second gear wheel 58 are respectively installed between the first bracket 54 and the second bracket 59. The first drive swing arm 56 and the second gear wheel 58 are in coaxial movement with the first gear wheel 55. The second drive swing arm 57 is provided with a third gear wheel 571 moving in the same axial as the second gear wheel 58. The third gear wheel 58 is meshed with the second gear wheel 58. The first drive swing arm 56 is connected to the drainage valve 22 of the toilet pan through a draining drawstring 23. The drainage valve 22 is in the form of lid drainage valve; the second drive swing arm 57 is connected to the rotary support 41 through the activating drawstring 42. The reset elastic part is specifically set to be a spring 53, also with a face cover 51 fixed on the first bracket 54 by screws to limit the position of the button 52 in order to prevent the button 52 from moving out of the first bracket 54 under the impact of the spring 53. When pressing the button 52, the teeth strip urges the first gear wheel 55, the second gear wheel 58 and the first drive swing arm 56 to rotate, then makes the first drive swing arm 56 pulling the draining drawstring 23 in result of opening the drainage valve 22 of the toilet pan. Meanwhile, the second gear wheel 58 urges the second drive swing arm 57 and the third gear wheel 571 to rotate in anti-direction, and then makes the second drive swing arm 57 pull the activating drawstring 42 in result of opening the lid 40 in the water storage box 10.

During water storage process, the lid 40 keeps in close by the own weight of the weight balancing block 47, water flows from the inlet valve 21 through the inlet tube 24, the water-through cavity 14, the back flow channel 13 then into the water storage area 12. With the continuous movement of water, the water storage area 12 is full then water overflows to other area of the water storage box 10. Before the first time of water entering, there is no water in the water storage area 12, after that every time before water inlet, there is certain water remained in the water storage area 12 without being drained out during the drainage of the water storage box 10. Therefore, every time when water enters (except the first time), due to water remained in the water storage area 12 and the setting of the back flow channel 13, there would be difference existing in height during water inlet, and due to little impact of water, the noise generated by water inlet impact on the water storage box 10 would be eliminated for reducing the water inlet noise.

Figure 14:
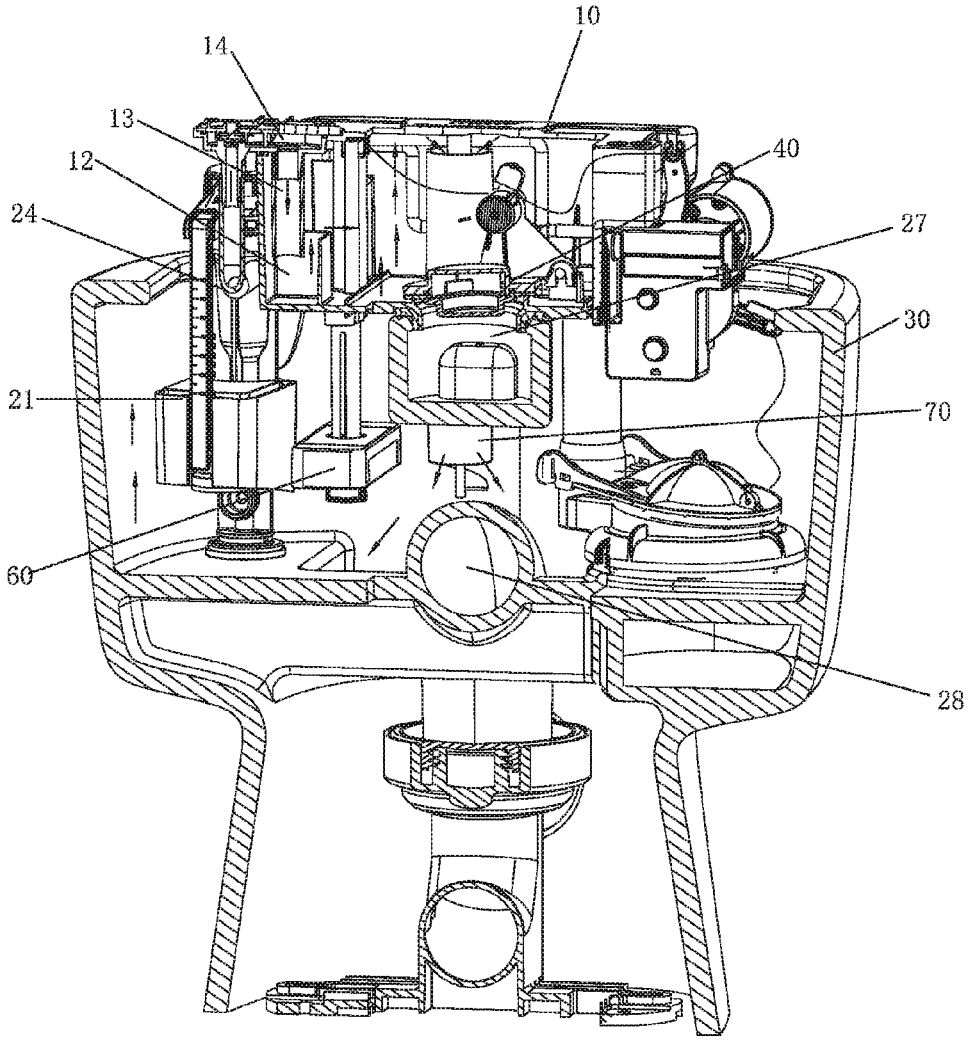
FIG. 14 illustrates a water inlet status view of the device of the invention.

With the water inlet process continue on, the water level of the water storage box 10 would go up gradually, when the water level up to the height of the overflow tube 70, water would go into the overflow tube 70, then overflowed into the cistern 30 through the overflow tube 70, as shown in FIG. 14. Due to the overflow tube 70 extending below the water level of cistern 30 after drainage and the setting of the muffler 80, when water flows into the cistern 30 through the overflow tube 70, water would not make direct impact on the water surface of the cistern 30, so that through the muffler 80 the water flowing route would be prolonged to slow the flow speed and scatter the water flow, consequently, the impact of water will be reduced and the water inlet noise will be eliminated. When the water level of the cistern 30 going up to the required working water level, the inlet valve 21 would stop water inlet to finish the inlet process. The float object 60 set in the cistern 30 will go up with the raise of the water level of the cistern 30.

Figure 15:
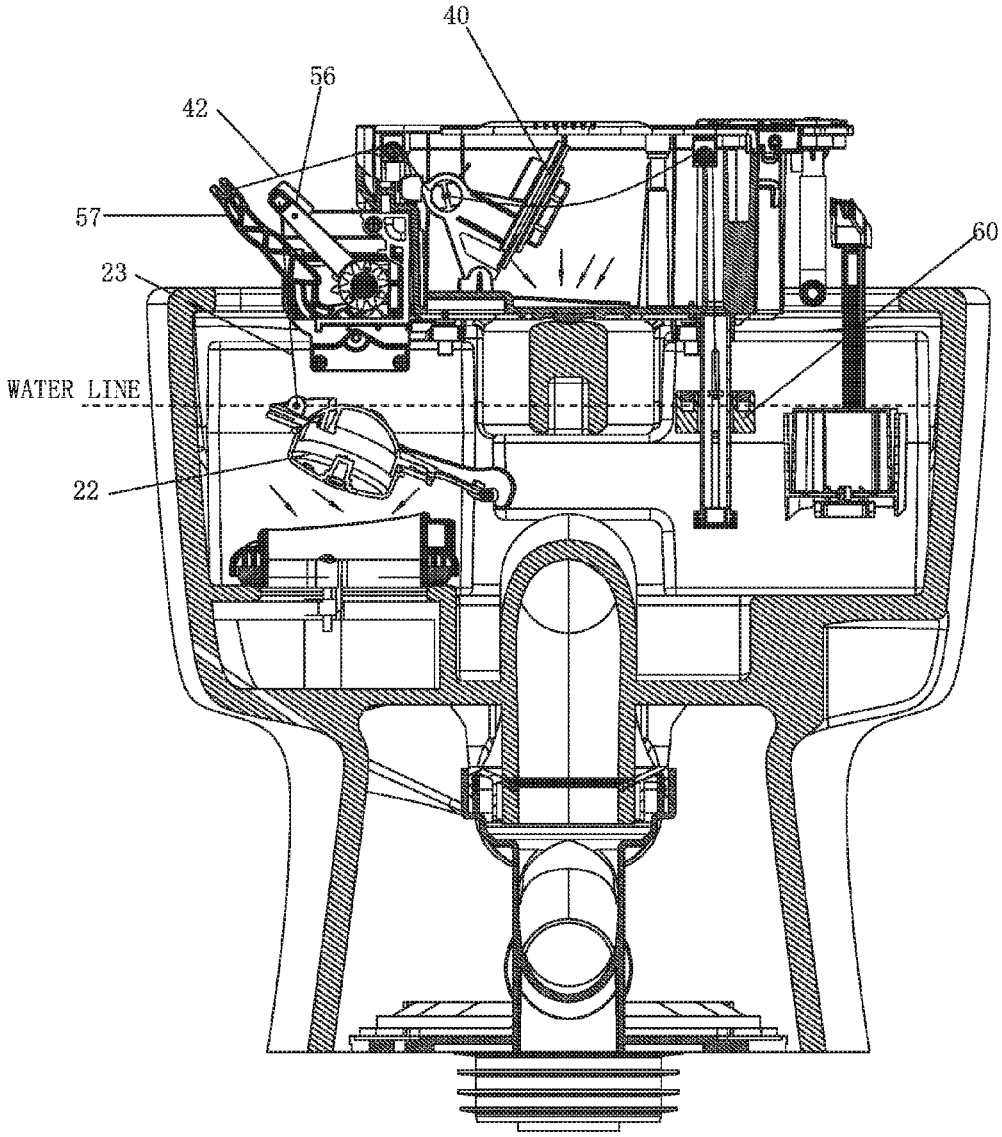
FIG. 15 illustrates a water drain status view of the device of the invention.
Figure 16:
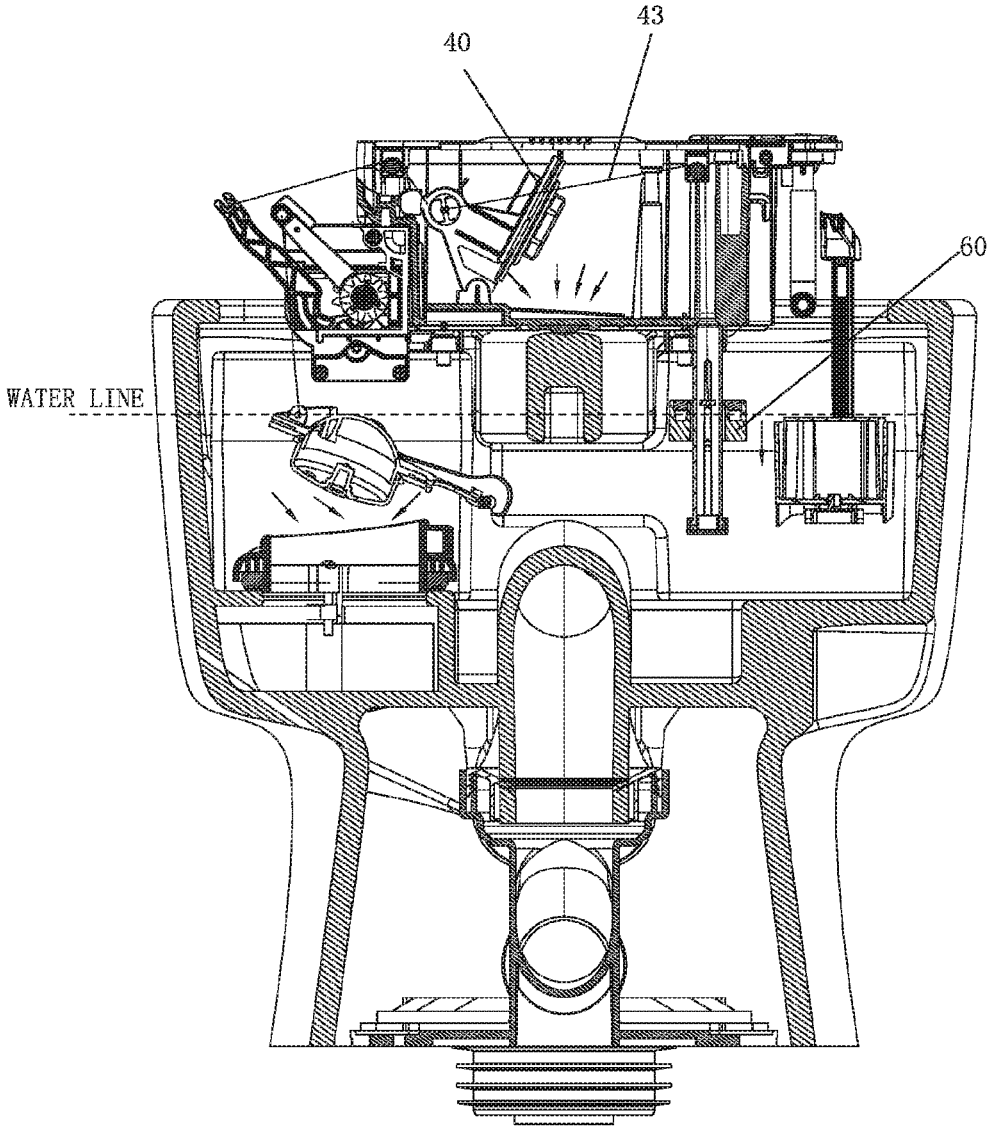
FIG. 16 illustrates the status view of the process of water drain of the device of the invention.
Figure 17:
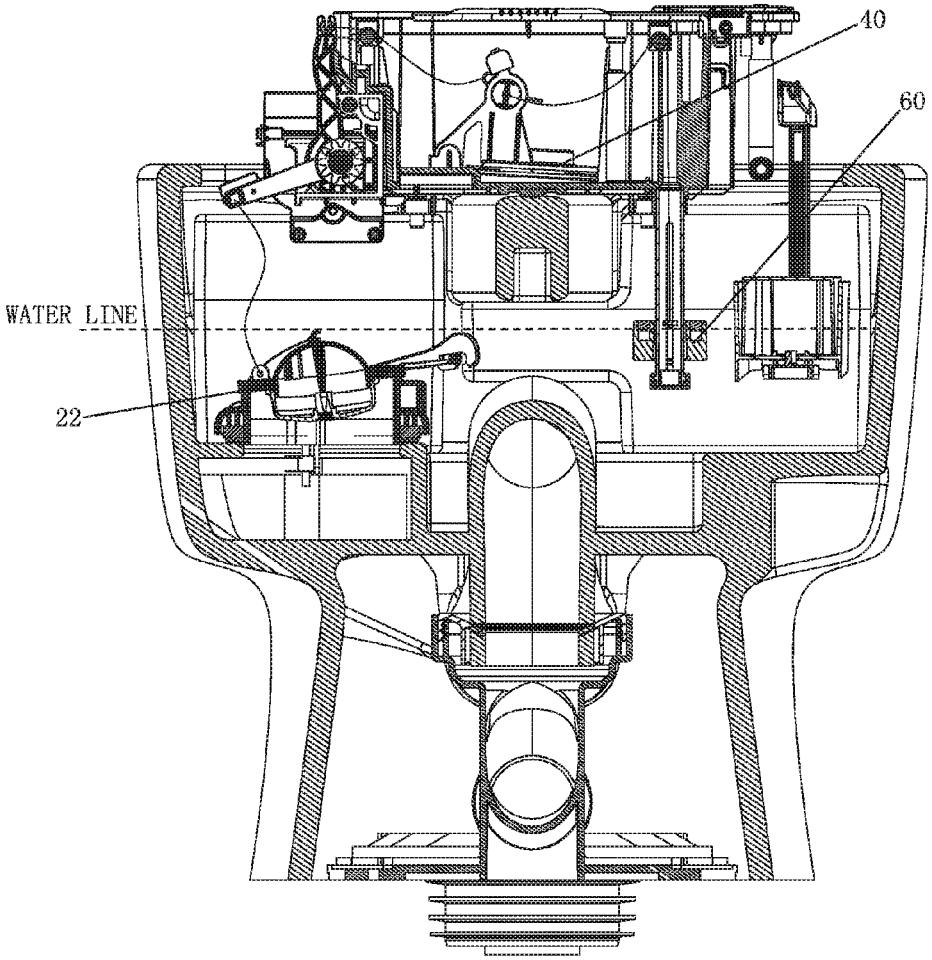
FIG. 17 illustrates the status view of finishing drainage of water drain of the device of the invention.

As shown in FIGS. 15, 16, 17, when water is drained, press the button 52, the first drive swing arm 56 of the drive mechanism 50 would pull the draining drawstring 23 to open the drainage valve 22, the second drive swing arm 57 of the drive mechanism 50 would pull the activating drawstring 42 to open the lid 40. Then, water in the cistern 30 will flush to the injection waterway 28 of the toilet pan while water in the water storage box 10 will flush to the flush rim waterway 27. The lid 40 keeps in open by the own weight of the weight balancing block 47. The float object 60 will go down with the descend of the water level of the cistern 30, then gradually strains the closing drawstring 43 until to drive the lid 40 to close. After the process of drainage, the drainage valve 22 will be closed, the inlet valve will be with water inlet, then the water storage process will be repeated as above mentioned.

Although the present invention has been described with reference to the preferred embodiments thereof for carrying out the patent for invention, it is apparent to those skilled in the art that a variety of modifications and changes may be made without departing from the scope of the patent for invention which is intended to be defined by the appended claims.

What is claimed is:

1. A water replenishing device for a flush rim of a toilet connected to a cistern, drainage of the water replenishing device being independent from drainage of the cistern, the water replenishing device comprising:

a water storage box that is provided with a water inlet in a top portion thereof, that is provided with a drainage outlet in a bottom portion thereof that communicates with a waterway of the flush rim of the toilet, that has a water storage area, and that has a backflow channel one end of which is connected to the water inlet and another end of which extends to the water storage area and is located below or equal to the highest water level of the water storage area; and a lid provided in the water storage box to open or close the drainage outlet, wherein the top portion of the water storage box is disposed with a water-through cavity that communicates with the water inlet, that has an upper cavity wall which has defined therein an atmospheric communication hole, and that has a bottom portion disposed which has defined therein a water entry hole connected to a water source, wherein the atmospheric communication hole is positioned to correspond to the water entry hole in an upper and lower manner and is provided with an anti-siphon cushion, and the upper cavity wall of the water-through cavity is downwardly provided with an enclosed-type isolation wall, and the anti-siphon cushion is placed inside the enclosed-type isolation wall.

2. The water replenishing device for a flush rim according to claim 1, wherein the water storage box has an overflow tube having a bottom end that extends into the cistern and is located below or equal to the water level of the cistern after drainage thereof.

3. The water replenishing device for a flush rim according to claim 2, further comprising a muffler provided in the overflow tube that comprises a center shaft and a spiral blade disposed spirally and downwardly along the center shaft, the spiral blade having an outer diameter adapted to an inner diameter of the overflow tube, and a bottom end positioned below or equal to the water level of the cistern after drainage thereof.

4. The water replenishing device for a flush rim according to claim 2, wherein the water storage box has an inner surface having a top surface, and wherein a stop pillar is provided that extends downwardly from the top surface of the inner side of the water storage box and into the overflow tube, and that has an outer diameter that is smaller than an inner diameter of the overflow tube.

5. The water replenishing device for a flush rim according to claim 1, wherein the anti-siphon cushion comprises:

a guiding pillar movably inserted to the atmospheric communication hole;

a first sealing plate coupled outside of the guiding pillar and placed below the atmospheric communication hole; and a second sealing plate that is integrally molded at a bottom end of the guiding pillar, that has a common axis with the guiding pillar, and onto which the first sealing plate is set.

6. The water replenishing device for a flush rim according to claim 1, wherein the lid is provided in the water storage box via a rotary support that is connected to a drive mechanism via an activating drawstring to control opening of the lid, and wherein the water replenishing device further comprises a float object provided in the cistern for controlling closure of a flap, and a closing drawstring provided to connect the float object to the rotary support.

7. The water replenishing device for a flush rim according to claim 6, further comprising a weight balancing block disposed on the rotary support; a first connection piece; and a second connection piece, wherein the first connection piece and the second connection piece are rotably installed on the rotary support or on the weight balancing block, the activating drawstring being connected to the first connection piece, and the closing drawstring being connected to the second connection piece.

8. The water replenishing device for a flush rim according to claim 6, wherein the float object has a water storage cavity, and wherein the water storage box is vertically disposed and is provided with a guiding tube having a bottom end that extends to the bottom of the water storage box, the float object is movably coupled outside of the guiding tube for up-down movement along the guiding tube, one end of the closing drawstring is connected to the rotary support and another end of the closing drawstring is connected to the float object through the guiding tube, the water storage box is disposed with a water replenishing tube to replenish the water storage cavity of the float object, and water flows out of the replenishing tube and then flows into the water storage cavity of the float object along an outer sidewall of the water storage box.

9. A toilet, comprising a water replenishing device for a flush rim according to claim 1, wherein the water storage box is set on an upper part of the cistern, water is supplied from an inlet valve inside the cistern; the drainage outlet of the water storage box communicates with a waterway of the flush rim, and the lid is linked with a drainage valve of the toilet to open.

10. The toilet according to claim 9, wherein the lid is installed in the water storage box with a rotary support that is connected to a drive mechanism provided with an activating drawstring, the lid and the drainage valve of the toilet are controlled by the drive mechanism to open, the drainage valve of the toilet is a lid drainage valve, and wherein the toilet further comprises a float object provided in the cistern for controlling the lid to close, and connected to the rotary support with a closing drawstring.

11. The toilet according to claim 10, wherein the float object is provided with a water storage cavity that is vertically disposed with a guiding tube having a bottom end that extends into the cistern, and the float object is movably coupled outside of the guiding tube with top-down movement along the guiding tube, one end of the closing drawstring is connected to the rotary support and another end of the closing drawstring is connected to the float object through the guiding tube, and wherein the water storage box is disposed with a water replenishing tube to replenish the water storage cavity of the float object, water is supplied from the inlet valve inside the cistern into the water replenishing tube, water flows out of the replenishing tube and then flows into the water storage cavity of the float object along an outer sidewall of the water storage box.

12. The toilet according to claim 10, wherein the drive mechanism comprises:

a fixed body;

a first drive swing arm;

a second drive swing arm;

a button that is provided with a teeth strip and that is movably connected to the fixed body with a reset elastic part provided there between;

a first gear wheel that is rotatably connected to the fixed body and that meshes with the teeth strip of the button; and a second gear wheel, and wherein the first drive swing arm, the second drive swing arm and the second gear wheel are respectively installed on the fixed body, and the first drive swing arm and the second gear wheel are in coaxial movement with the first gear wheel, the second gear wheel is provided with a third gear wheel moving with respect to an axis that is the same as that of the second gear wheel, and that is meshed with the second gear wheel, the first drive swing arm is connected to the drainage valve of the toilet through a draining drawstring, and the second drive swing arm is connected to the rotary support through the activating drawstring.

13. A water replenishing device for a flush rim of a toilet connected to a cistern, drainage of the water replenishing device being independent from drainage of the cistern, the water replenishing device comprising:

a water storage box that is provided with a water inlet in a top portion thereof, that is provided with a drainage outlet in a bottom portion thereof that communicates with a waterway of the flush rim of the toilet, that has a water storage area, and that has a backflow channel one end of which is connected to the water inlet and another end of which extends to the water storage area and is located below or equal to the highest water level of the water storage area; and a lid provided in the water storage box via a rotary support that is connected to a drive mechanism via an activating drawstring to control opening of the lid, wherein the water replenishing device further comprises a float object provided in the cistern for controlling closure of a flap, and a closing drawstring provided to connect the float object to the rotary support, and wherein the float object has a water storage cavity, and wherein the water storage box is vertically disposed and is provided with a guiding tube having a bottom end that extends to the bottom of the water storage box, the float object is movably coupled outside of the guiding tube for up-down movement along the guiding tube, one end of the closing drawstring is connected to the rotary support and another end of the closing drawstring is connected to the float object through the guiding tube, the water storage box is disposed with a water replenishing tube to replenish the water storage cavity of the float object, and water flows out of the replenishing tube and then flows into the water storage cavity of the float object along an outer sidewall of the water storage box.

14. A toilet, comprising:

a flush rim; and a water replenishing device for the flush rim connected to a cistern, drainage of the water replenishing device being independent from drainage of the cistern, the water replenishing device being comprised of:

a water storage box provided with a water inlet in a top portion thereof, provided with a drainage outlet in a bottom portion thereof that communicates with a waterway of the flush rim of the toilet, having a water storage area, and having a backflow channel one end of which is connected to the water inlet and another end of which extends to the water storage area and is located below or equal to the highest water level of the water storage area; and a lid provided in the water storage box to open or close the drainage outlet, wherein the water storage box is set on an upper part of the cistern, water is supplied from an inlet valve inside the cistern; the drainage outlet of the water storage box communicates with a waterway of the flush rim and the lid is linked with a drainage valve of the toilet to open, wherein the lid is installed in the water storage box with a rotary support that is connected to a drive mechanism provided with an activating drawstring, the lid and the drainage valve of the toilet are controlled by the drive mechanism to open, the drainage valve of the toilet is a lid drainage valve, wherein the toilet further comprises a float object provided in the cistern for controlling the lid to close, and connected to the rotary support with a closing drawstring, wherein the drive mechanism comprises:

a fixed body;

a first drive swing arm;

a second drive swing arm;

a button that is provided with a teeth strip and that is movably connected to the fixed body with a reset elastic part provided there between;

a first gear wheel that is rotatably connected to the fixed body and that meshes with the teeth strip of the button; and a second gear wheel, and wherein the first drive swing arm, the second drive swing arm and the second gear wheel are respectively installed on the fixed body, and the first drive swing arm and the second gear wheel are in coaxial movement with the first gear wheel, the second gear wheel is provided with a third gear wheel moving with respect to an axis that is the same as that of the second gear wheel, and that is meshed with the second gear wheel, the first drive swing arm is connected to the drainage valve of the toilet through a draining drawstring, and the second drive swing arm is connected to the rotary support through the activating drawstring.

* * * * *